US009588485B1

(12) United States Patent
Lucenta et al.

(10) Patent No.: US 9,588,485 B1
(45) Date of Patent: Mar. 7, 2017

(54) SYSTEM AND METHOD FOR SPLITTING A PRINTER CARTRIDGE

(71) Applicant: CLOVER TECHNOLOGIES GROUP, LLC, Ottawa, IL (US)

(72) Inventors: Robert W. Lucenta, Oswego, IL (US); Daniel J. Andersen, Oak Forest, IL (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 0 days.

(21) Appl. No.: 14/881,534

(22) Filed: Oct. 13, 2015

(51) Int. Cl.
*G03G 21/00* (2006.01)
*G03G 21/18* (2006.01)
*B26D 7/02* (2006.01)

(52) U.S. Cl.
CPC ..... *G03G 21/181* (2013.01); *B26D 7/02* (2013.01)

(58) Field of Classification Search
CPC ..... G03G 15/043; G03G 21/181
USPC ..... 399/4, 109
See application file for complete search history.

(56) References Cited

U.S. PATENT DOCUMENTS 5,407,518 A 4/1995 Baley, Jr.
5,657,678 A * 8/1997 Cohen ..... G03G 15/0894 225/103
2003/0074794 A1* 4/2003 Stoick ..... B26D 3/169 30/101
2012/0291604 A1* 11/2012 Kozyrski ..... B26D 7/02 83/452

* cited by examiner

*Primary Examiner* — Quana M Grainger
(74) *Attorney, Agent, or Firm* — Michael Best & Friedrich LLP

(57) ABSTRACT

A system for splitting a printer cartridge. The system includes a cartridge holder, a cutting head, and a conveyor. The cartridge holder includes a receiver for receiving the printer cartridge, and a clamp for securing the printer cartridge in the receiver. The cutting head includes an idling cutting wheel configured to split the printer cartridge. The conveyor provides relative movement between the secured printer cartridge and the cutting head to affect splitting of the printer cartridge.

32 Claims, 17 Drawing Sheets

SYSTEM AND METHOD FOR SPLITTING A PRINTER CARTRIDGE

BACKGROUND

The present invention relates to remanufactured printer cartridges, and more specifically, splitting, cutting, or opening, a printer cartridge for remanufacturing purposes.

During remanufacturing, printer cartridges are split opened to provide access to the inside of the cartridge. Once opened, parts of the printer cartridge can be cleaned or replaced. Traditionally, printer cartridges are opened using a spinning saw blade (e.g., a circular saw) that saws through a portion of the printer cartridge. This technique removes a band of cartridge material corresponding to the width of the saw blade that must later be replaced when the cartridge is reassembled to maintain the original cartridge dimensions. In addition, this technique generates small and highly abrasive cutting chips that must be carefully removed from the internal cartridge components prior to reassembly to avoid potential print defects in the remanufactured cartridge.

SUMMARY

In one embodiment, the invention provides a system for splitting a printer cartridge. The system includes a cartridge holder, a cutting head, and a conveyor. The cartridge holder includes a receiver for receiving the printer cartridge, and a clamp for securing the printer cartridge in the receiver. The cutting head includes an idling cutting wheel configured to split the printer cartridge. The conveyor provides relative movement between the secured printer cartridge and the cutting head to affect splitting of the printer cartridge.

In another embodiment, the invention provides a method of splitting a printer cartridge. The method includes receiving the printer cartridge into a receiver of a cartridge holder. The method further includes securing the printer cartridge into the receiver via a clamp of the cartridge holder. The method further includes splitting the printer cartridge via an idling cutting wheel of a cutting head. The method further includes providing relative movement between the secured printer cartridge and the idling cutting wheel to affect splitting of the printer cartridge.

In another embodiment, the invention provides a system for splitting a printer cartridge. The system includes a base, a cutting head coupled to the base, a conveyor coupled to the base, and a cartridge holder movably coupled to the conveyor. The cutting head includes an idling cutting wheel. The cartridge holder is configured to receive the printer cartridge and move the printer cartridge toward the idling cutting wheel to affect splitting of the printer cartridge by the idling cutting wheel.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
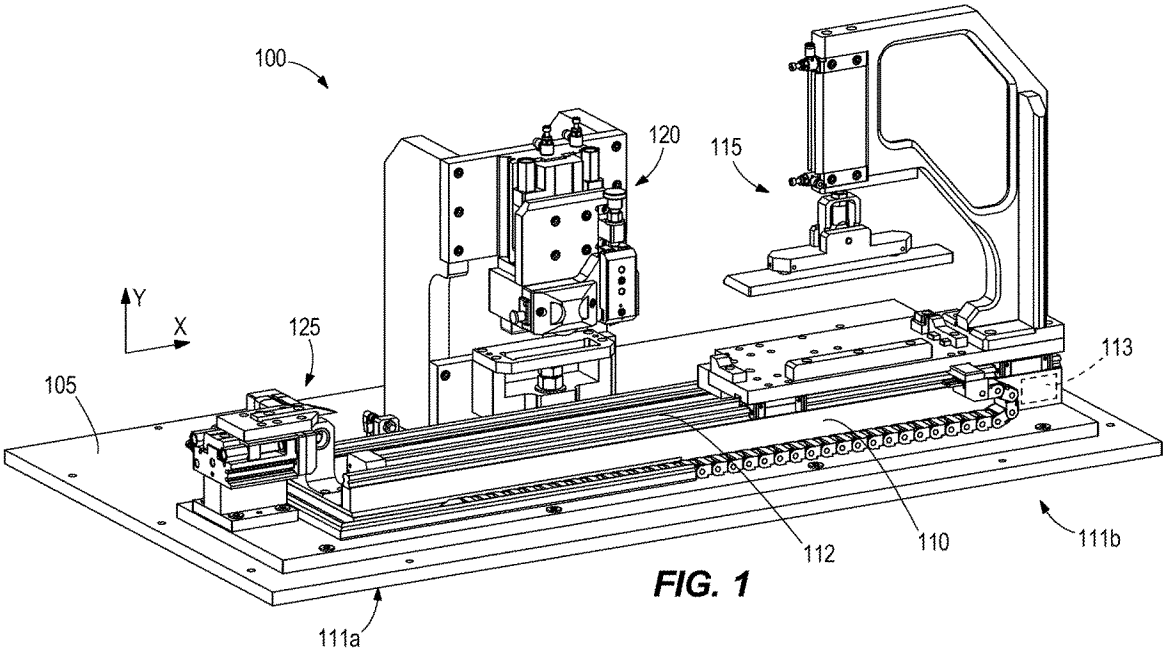
FIG. 1 is a perspective view of a system for splitting a printer cartridge according to one embodiment of the invention.
Figure 2:
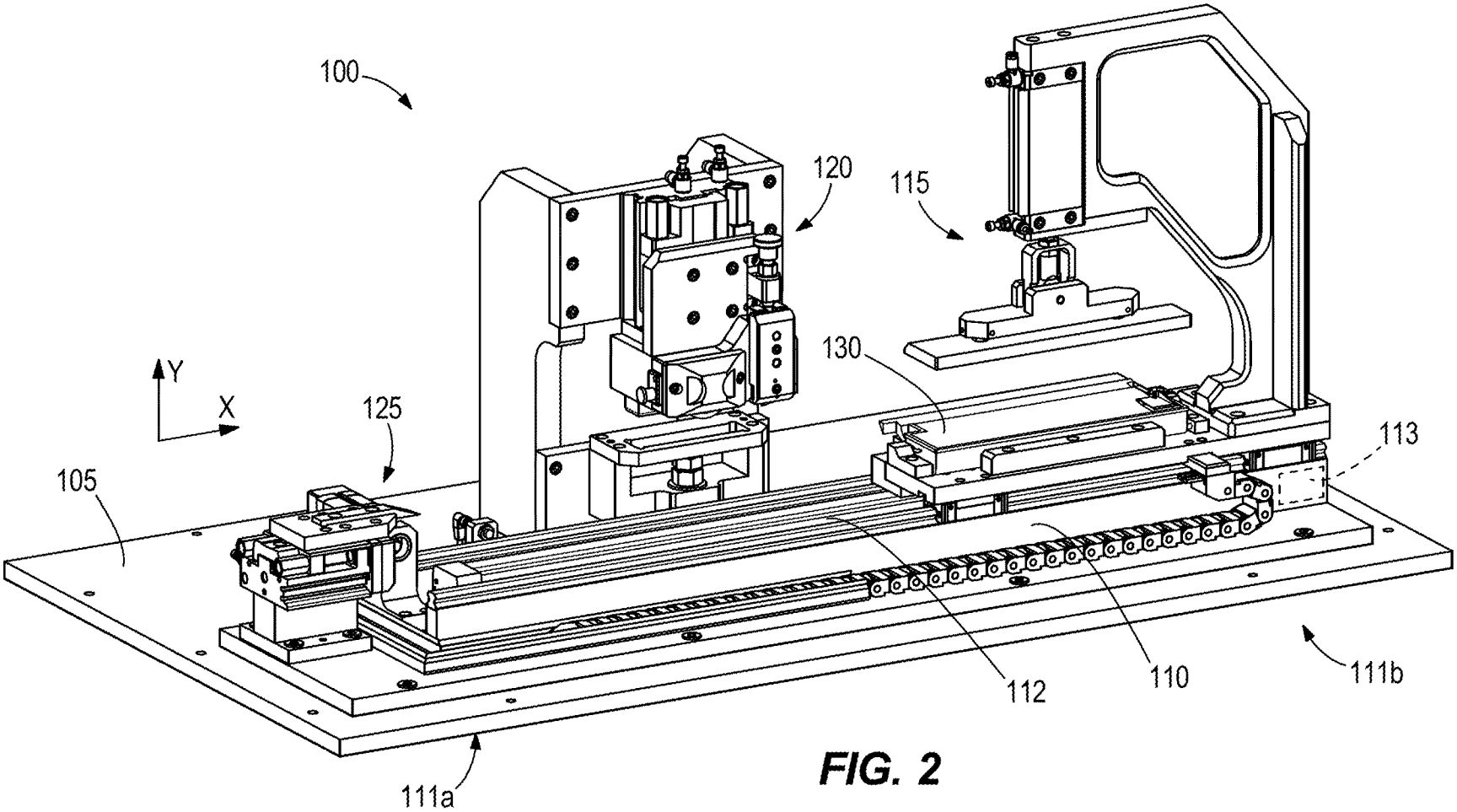
FIG. 2 is a perspective view of the system of FIG. 1 containing the printer cartridge.
Figure 3:
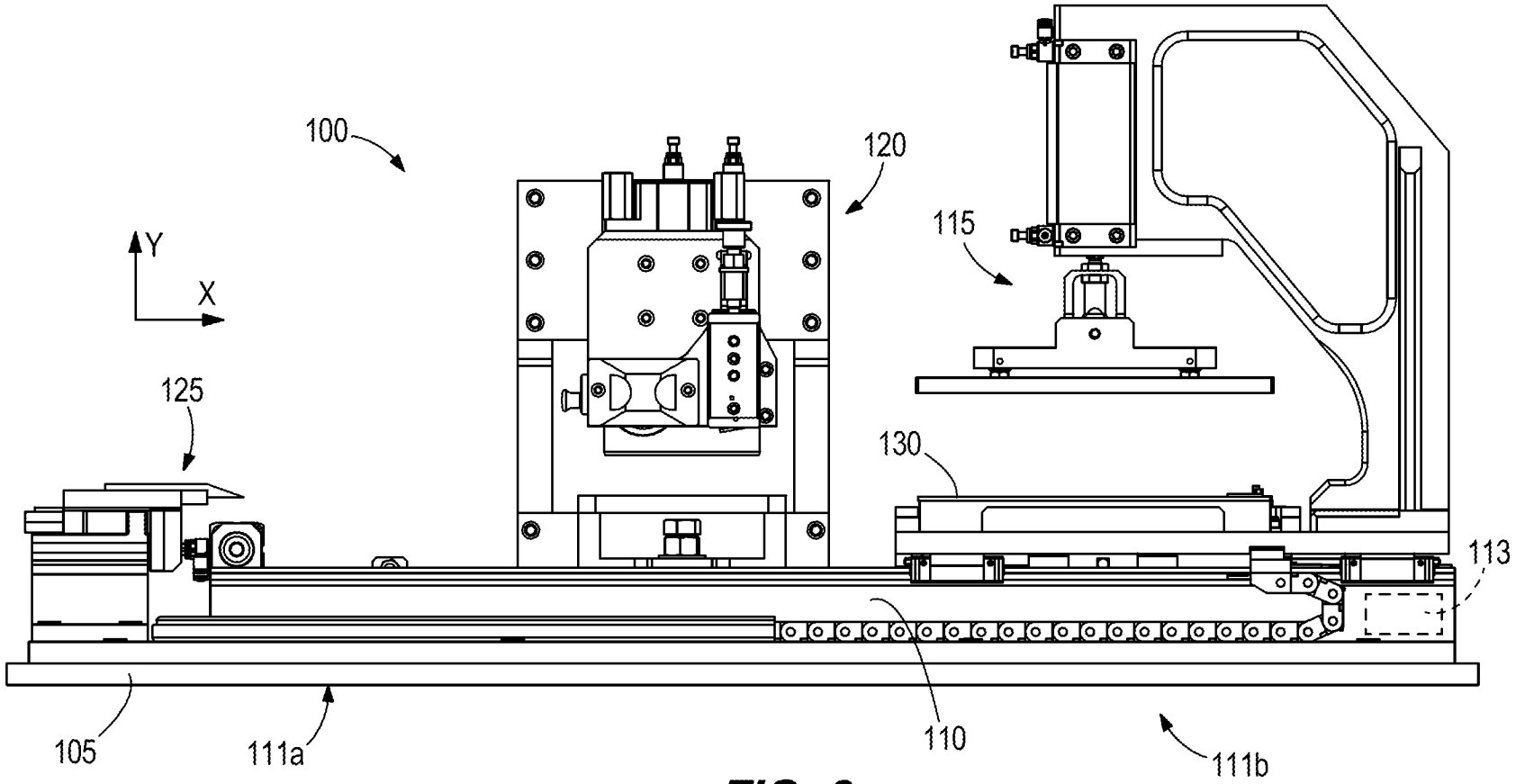
FIG. 3 is a front view of the system of FIG. 1 containing the printer cartridge.

FIGS. 1-3 illustrate a system 100 for splitting, or cutting, a printer cartridge according to one embodiment of the invention. The system 100 includes a base 105, a conveyor 110, a printer cartridge holder, or cartridge holder, 115, a cutting head 120, and a cartridge splitter 125. The conveyor 110, cutting head 120, and cartridge splitter 125 are coupled to the base 105. The cartridge holder 115 is movably coupled to the conveyor 110 and is configured to move in a latitudinal direction, represented as the x-axis. The cartridge holder 115 is configured to receive and secure a printer cartridge 130 and provide relative movement between the secured printer cartridge 130 and the cutting head 120, in the latitudinal direction, to affect splitting, or cutting, of the printer cartridge 130. Once split, the inside of the printer cartridge 130 can be accessed for cleaning and/or replacement of parts.

The base 105 is configured to support the conveyor 110, the cutting head 120, and the cartridge splitter 125. The conveyor 110 includes a first end 111*a*, a second end 111*b*, a track 112 and an actuator 113. The track 112, along with the actuator 113, moves the cartridge holder 115 in the latitudinal direction. In some embodiments, the track 112 is a slide, such as but not limited to, a ball slide or a linear ball slide. In some embodiments, the actuator 113 is a hydraulic actuator. In other embodiments, the actuator 113 is a motor, such as but not limited to, an alternating-current (AC) motor, a direct-current (DC) motor, a stepper motor, a synchronous motor, or a switched-reluctance motor. As used herein the term "conveyor" refers to any mechanism capable of guiding and/or causing movement of the cartridge holder 115 in the latitudinal direction to affect splitting or cutting of the printer cartridge 130 in the manner described.

Figure 5:
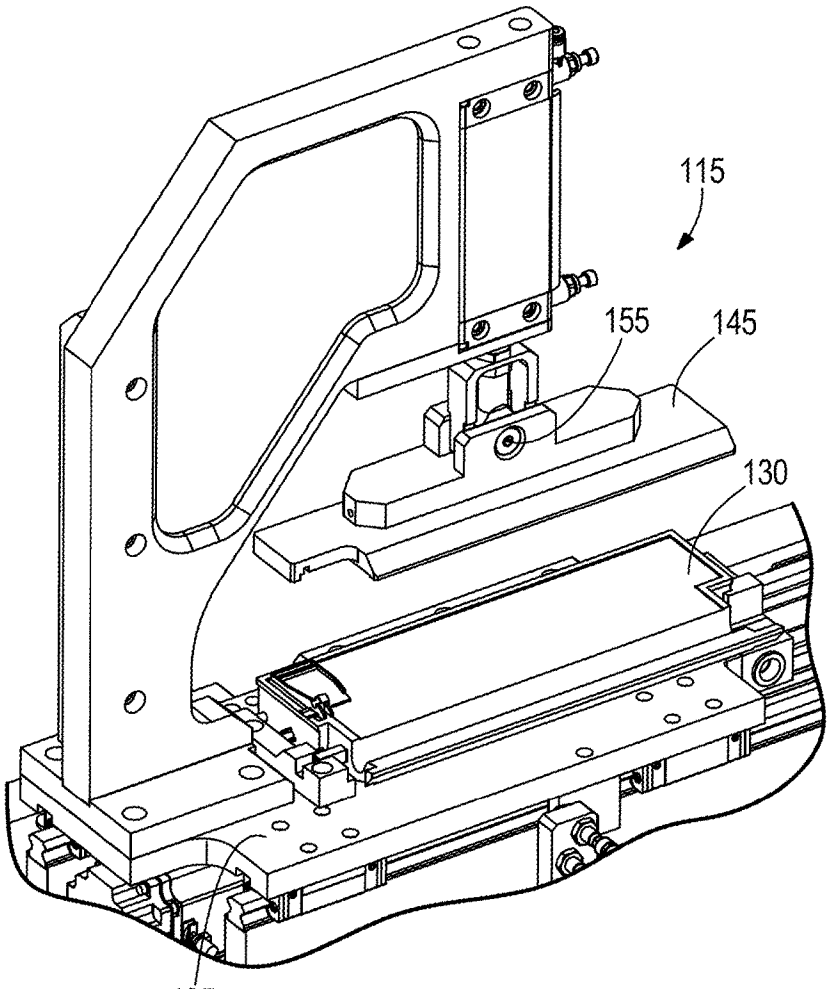
FIG. 5 is a perspective view of the cartridge holder of FIG. 4 containing the printer cartridge and in an unclamped position.
Figure 4:
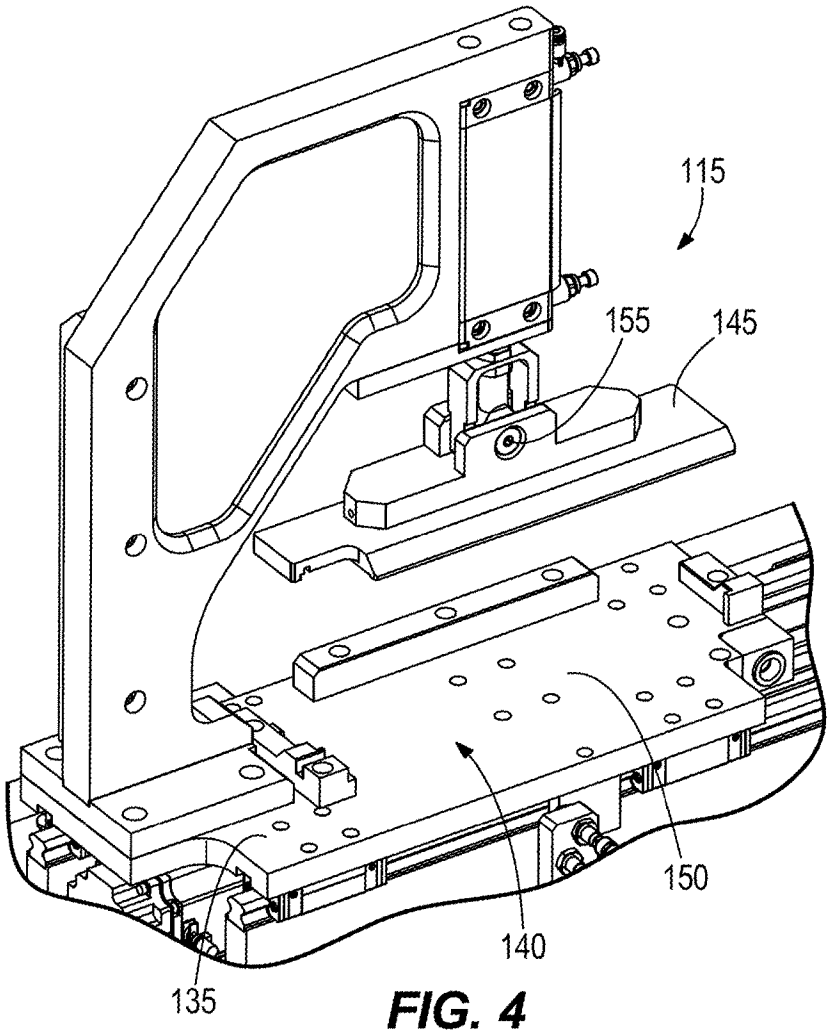
FIG. 4 is a perspective view of a cartridge holder of the system of FIG. 1 without the printer cartridge.
Figure 6:
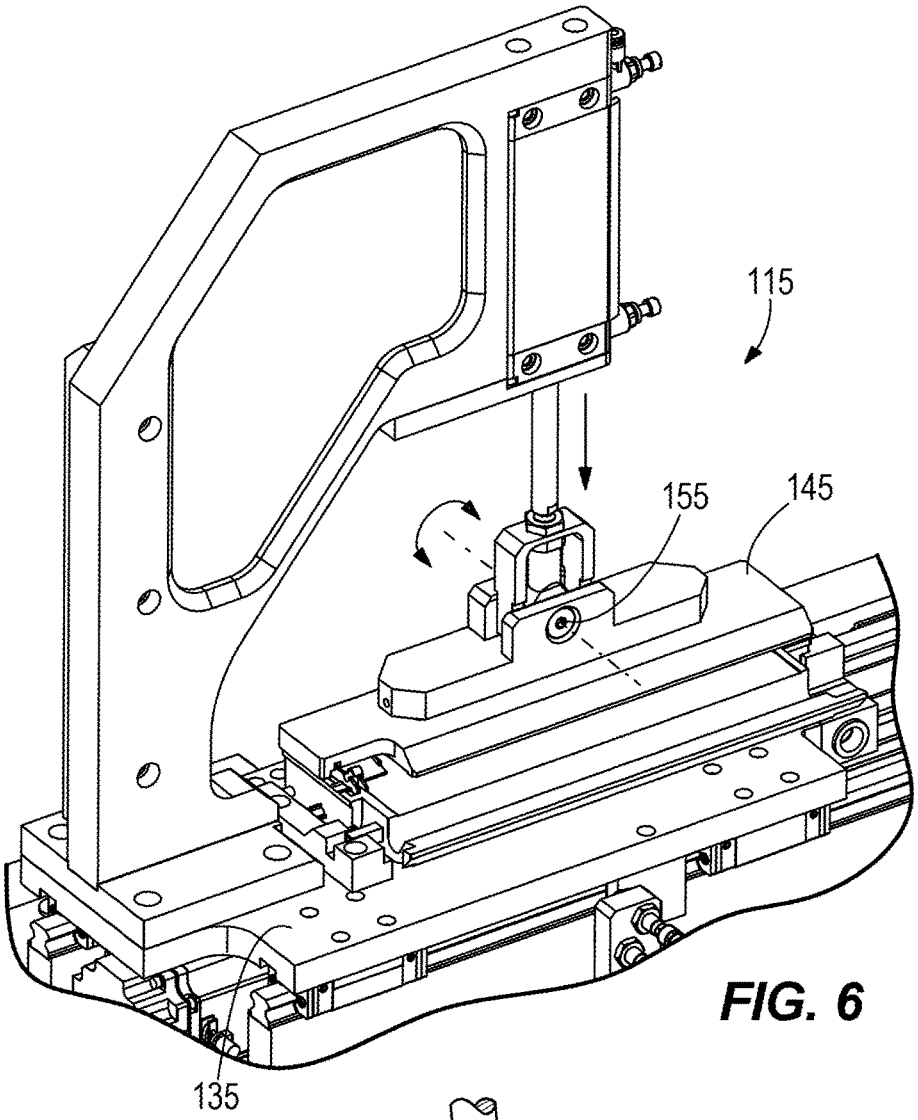
FIG. 6 is a perspective view of the cartridge holder of FIG. 4 containing the printer cartridge and in a clamped position.

FIGS. 4-6 illustrate the cartridge holder 115 according to some embodiments. FIG. 4 illustrates a perspective view of the cartridge holder 115 without the printer cartridge 130. The cartridge holder 115 includes a cartridge holder base 135, a receiver 140, and a clamp 145. The cartridge holder base 135 movably couples the receiver 140 and the clamp 145 to the conveyor 110. The receiver 140 includes a recess, or nest, 150 configured to receive the printer cartridge 130.

The clamp 145 is movably coupled to the cartridge holder base 135 and is configured to move in a longitudinal direction, represented as the y-axis (e.g., perpendicular to the direction of movement of the cartridge holder 115 along the conveyor 110). The clamp 145 is configured to be placed in an unclamped position (illustrated in FIGS. 4 and 5), in which the printer cartridge 130 is unsecured, and a clamped position (illustrated in FIG. 6), in which the printer cartridge 130 is secured within the recess 150 of the receiver 140. The clamp 145 is rotatably coupled to the cartridge holder base 135 via a pivot 155. The pivot 155 is configured to compensate for angular displacement of the printer cartridge 130. In some embodiments, the angular displacement results from inconsistencies or irregularities of the printer cartridge.

Figure 7:
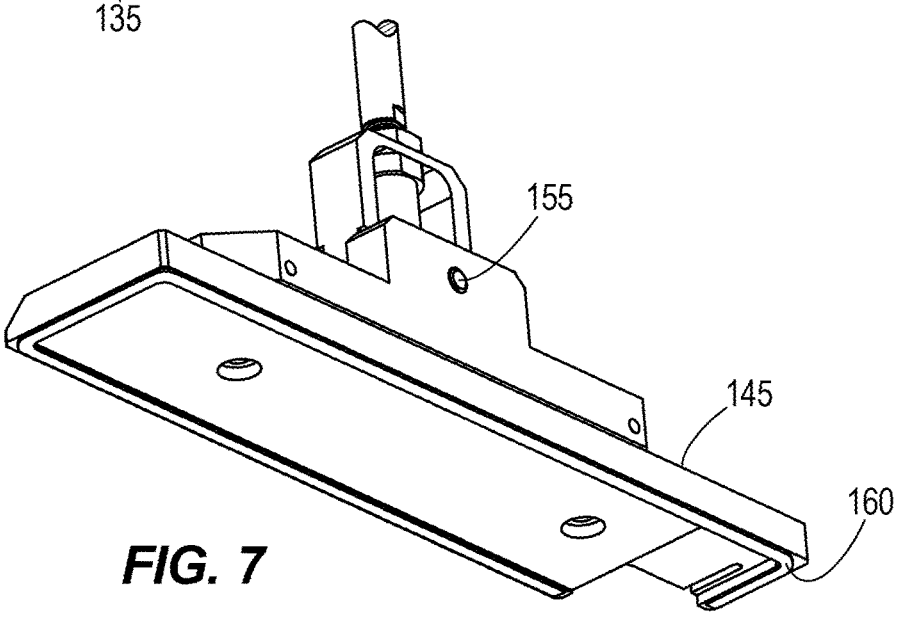
FIG. 7 is a bottom view of a clamp of the cartridge holder of FIG. 4.

FIG. 7 illustrates a bottom view of the clamp 145 according to one embodiment. In such an embodiment, the clamp 145 includes a clamp pad 160. When in the clamped position, the clamp pad 160 is in contact with the printer cartridge 130. In some embodiments, such as illustrated in FIG. 7, the clamp pad 160 is in contact with an outer edge of the printer cartridge 130.

Figure 8:
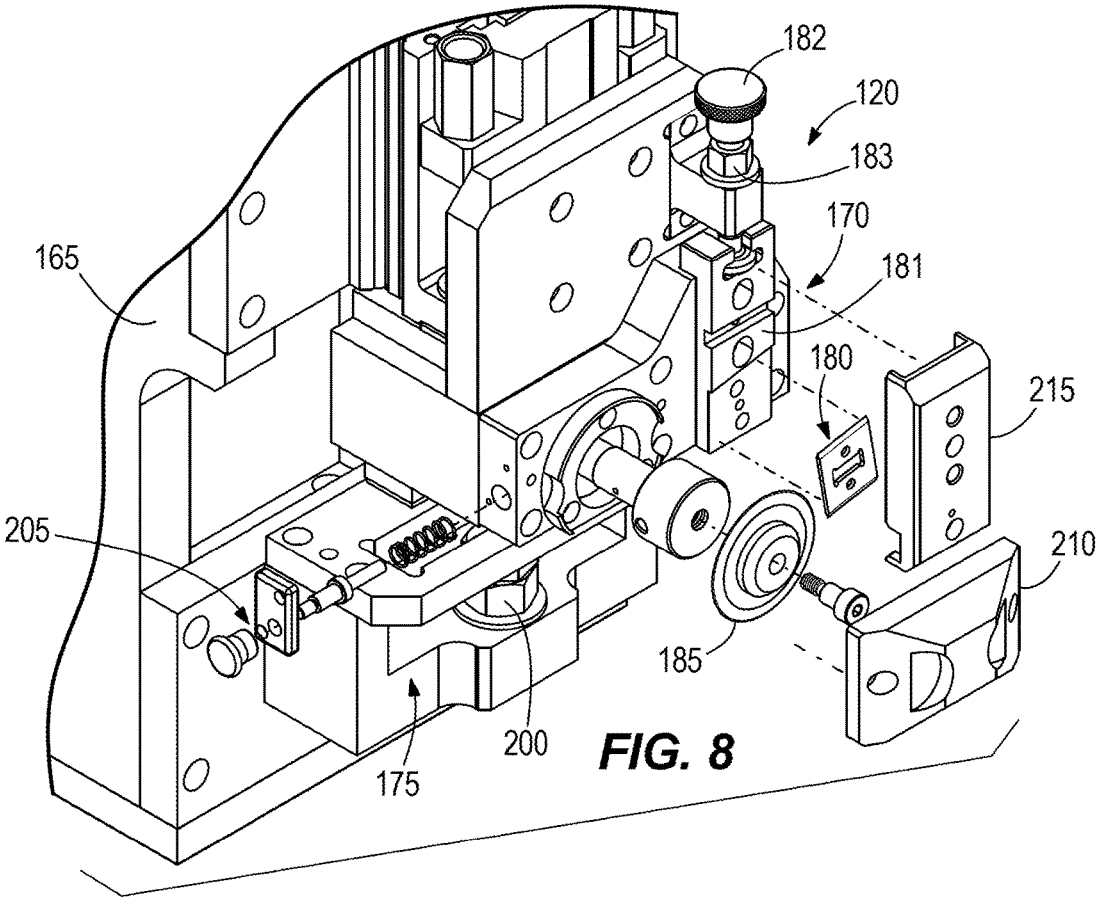
FIG. 8 is an exploded perspective view of a cutting head of the system of FIG. 1.
Figure 9:
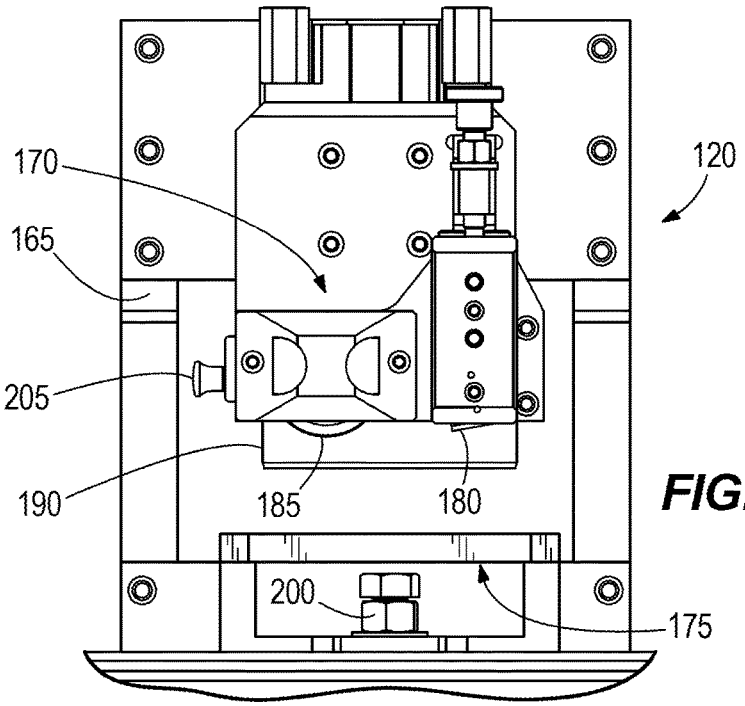
FIG. 9 is a front view of the cutting head of FIG. 8.

FIGS. 8 and 9 illustrate the cutting head 120 of the system 100 according to some embodiments. The cutting head 120 includes a cutting head base 165, a scorer and cutting assembly 170, and a stabilizer receiver 175. The cutting head base 165 couples the scorer and cutting assembly 170 and the stabilizer receiver 175 to the base 105.

The scorer and cutting assembly 170 includes a scorer 180, a cutting wheel 185, and a stabilizer 190. The scorer and cutting assembly 170 is movably coupled to the cutting head base 165 and is configured to move in a longitudinal direction (e.g., along the y-axis) from an unengaged position (illustrated in FIG. 9) to an engaged position (illustrated in FIG. 13).

Figure 15A:
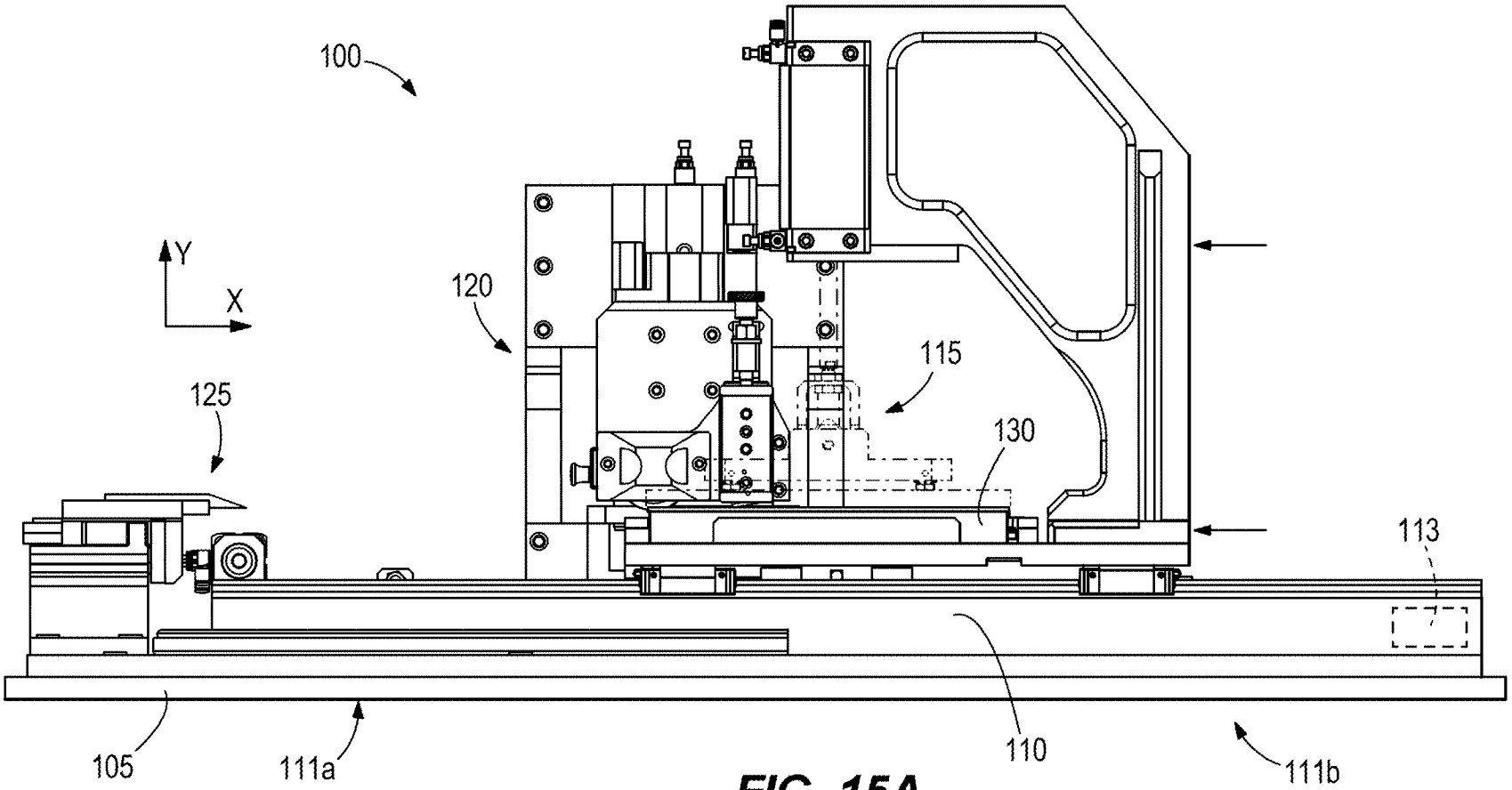
FIG. 15A is a front view of the system of FIG. 1 with the clamp of the cartridge holder removed for illustrative purposes and the printer cartridge in a first cutting position.
Figure 15B:
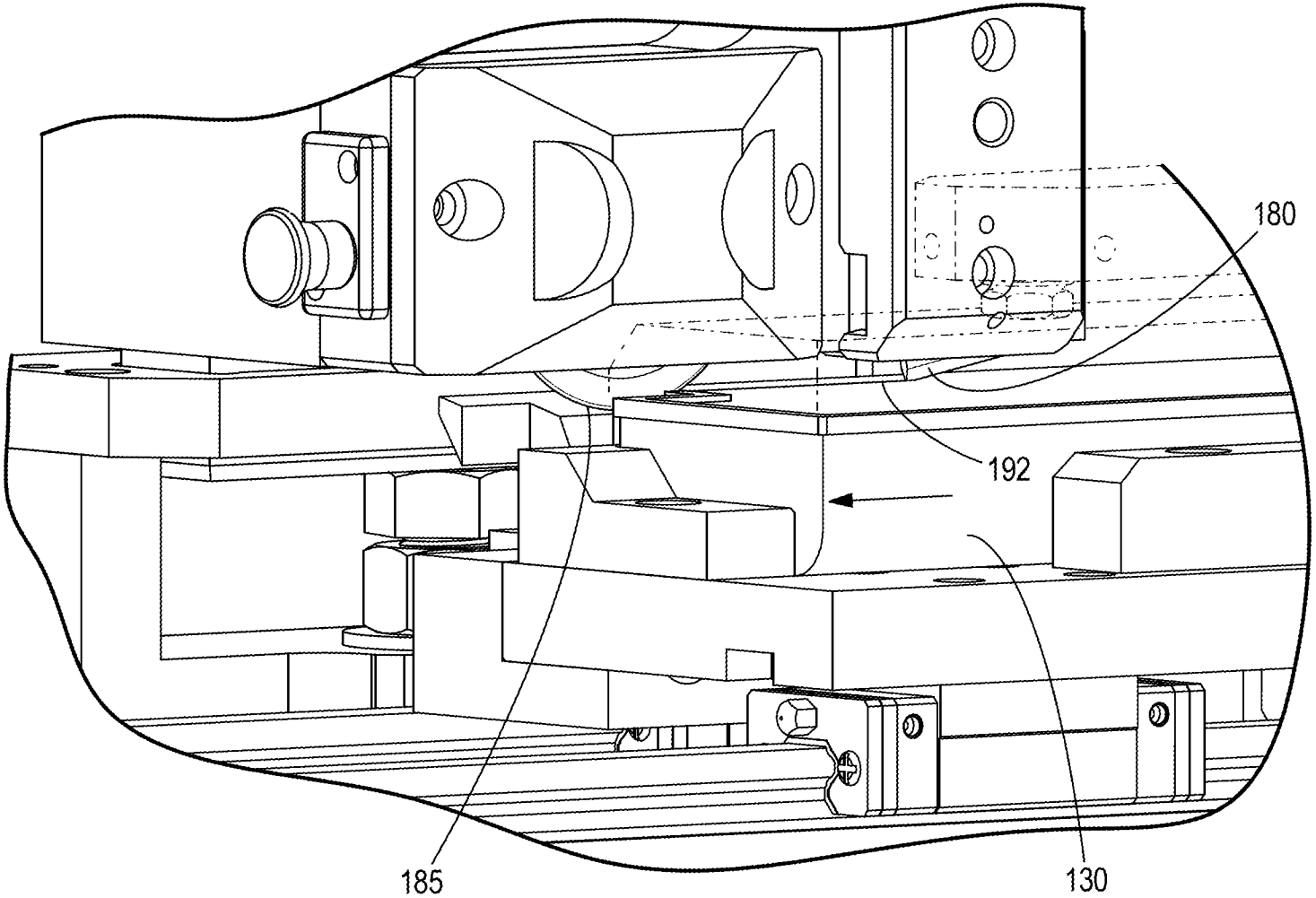
FIG. 15B is a perspective view of the printer cartridge in the first cutting position.
Figure 16A:
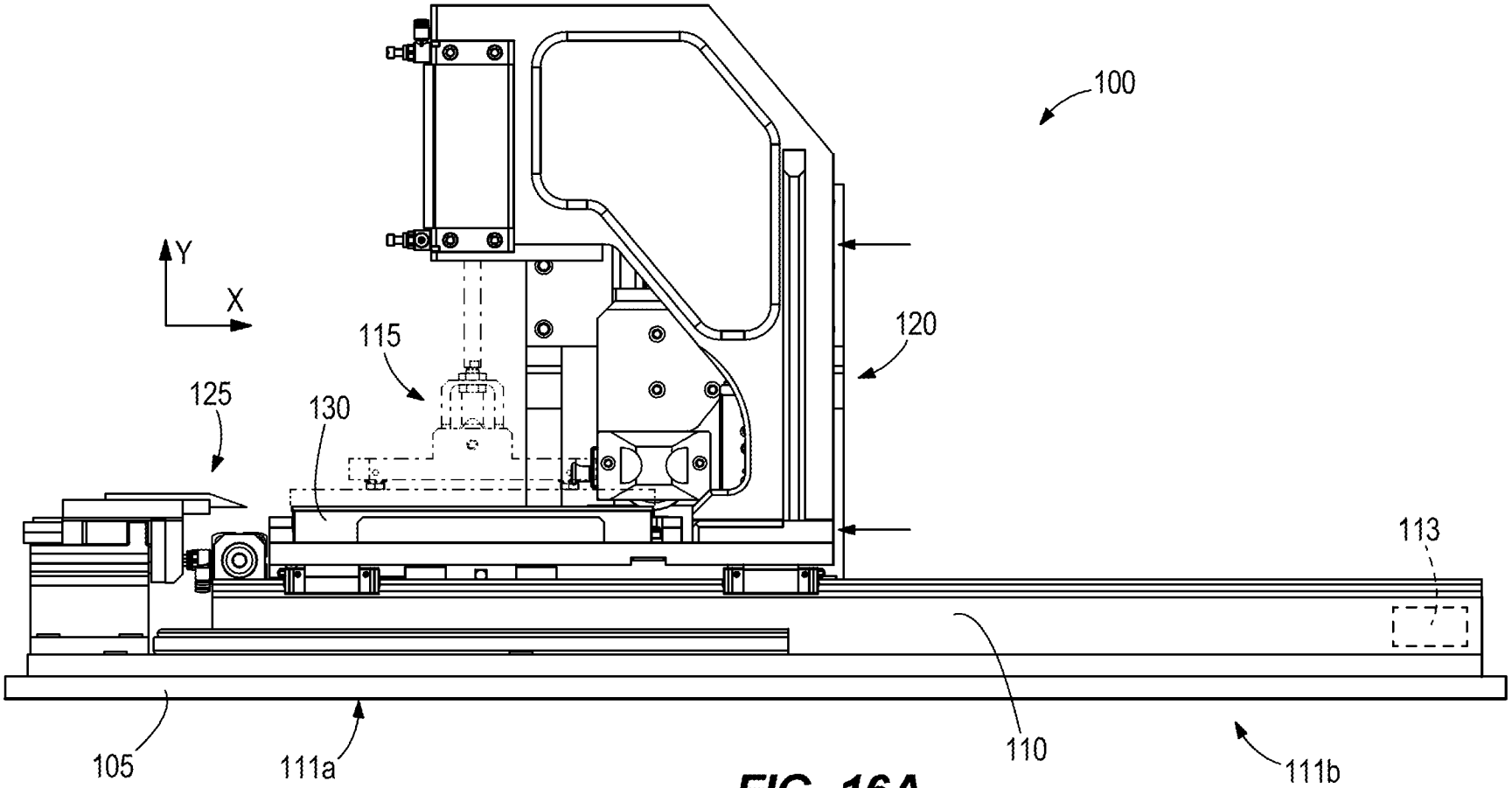
FIG. 16A is a front view of the system of FIG. 1 with the clamp of the cartridge holder removed for illustrative purposes and the printer cartridge in a second cutting position
Figure 16B:
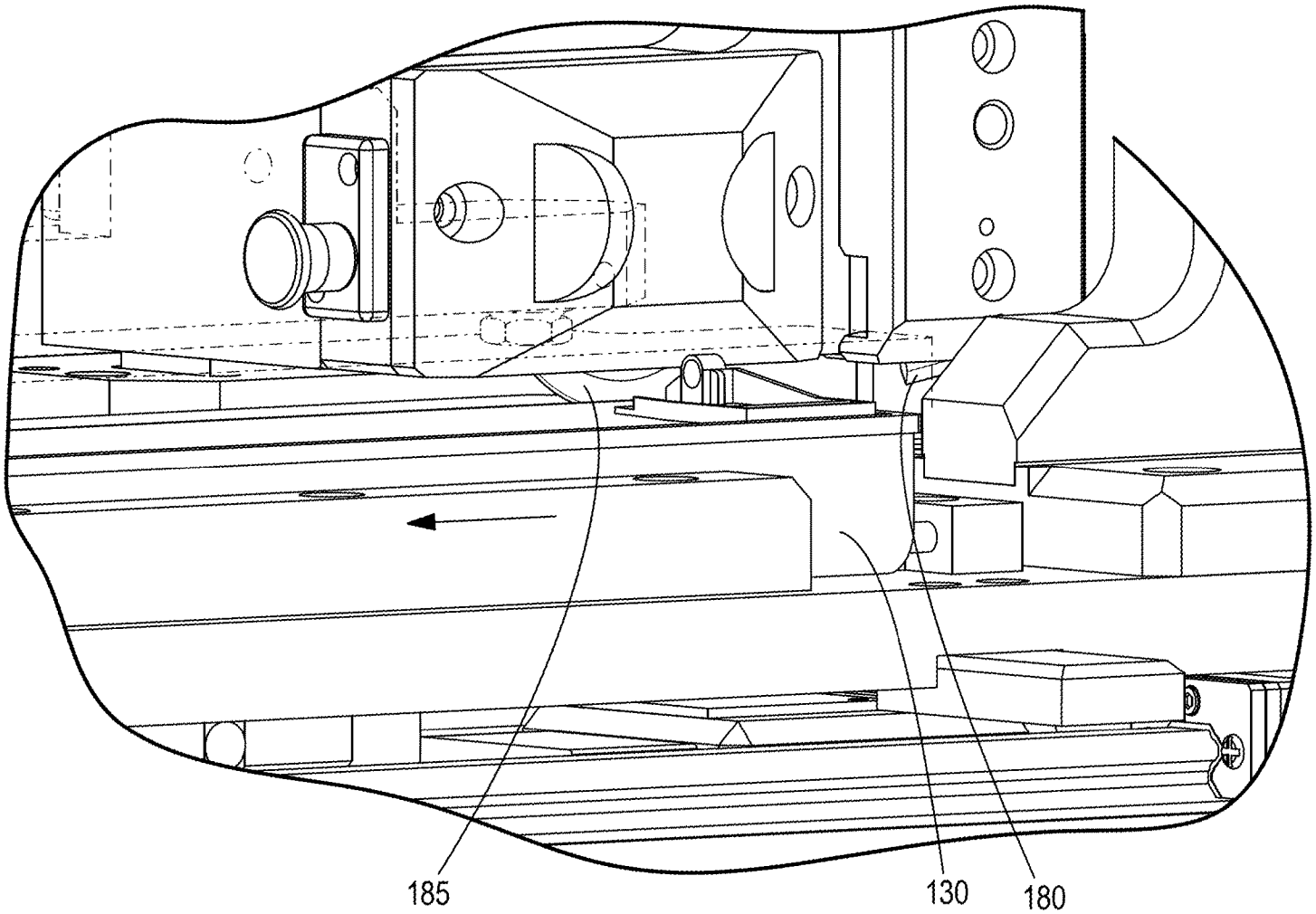
FIG. 16B is a perspective view of the printer cartridge in the second cutting position.
Figure 17:
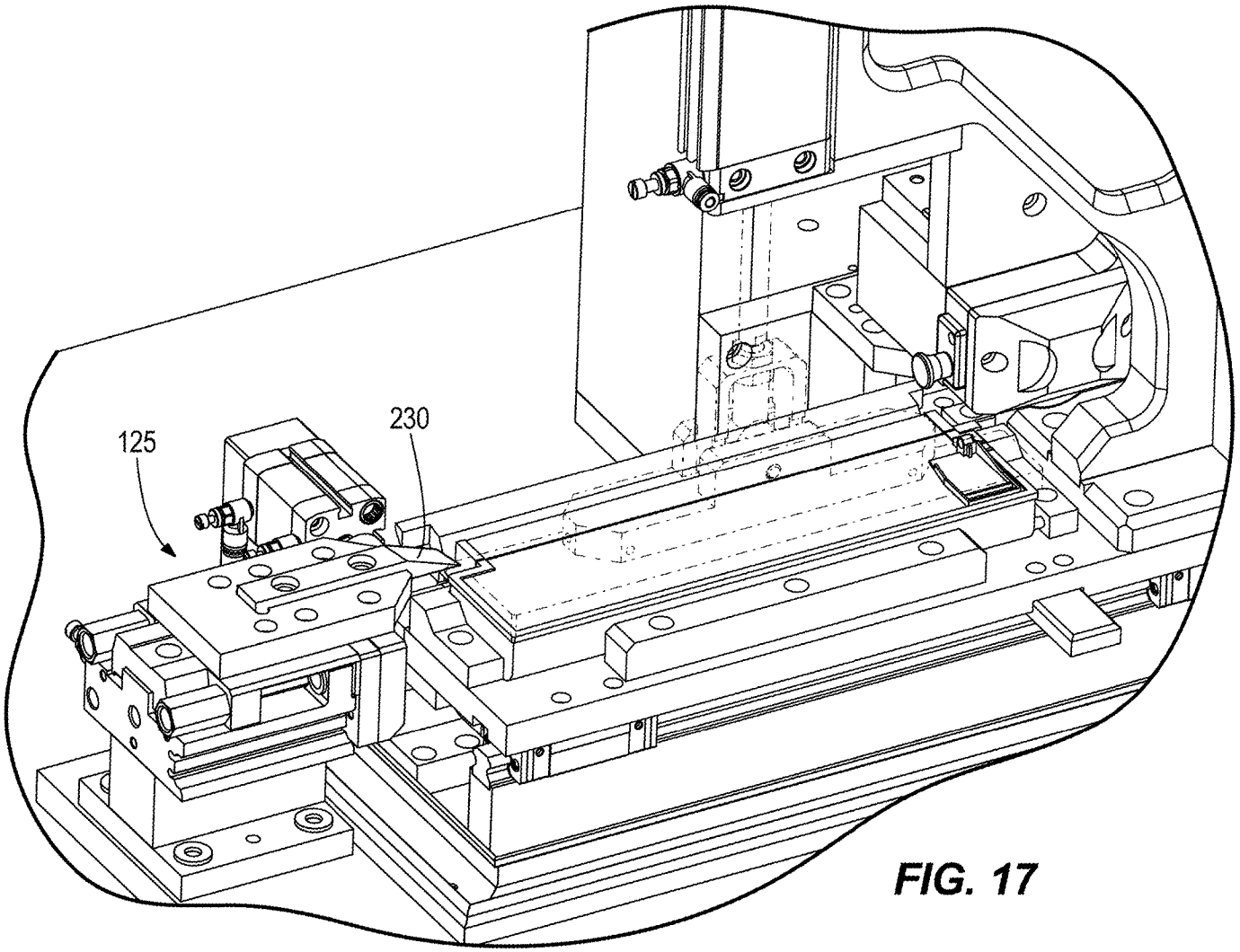
FIG. 17 is a perspective view of the system of FIG. 1 with the clamp of the cartridge holder removed for illustrative purposes after the printer cartridge has been cut by the cutting head.

The scorer 180 is moveably coupled to the scorer and cutting assembly 170 by a scorer carriage 181. More specifically, the scorer carriage 181 is slidably received within a channel defined by the scorer and cutting assembly 170 for longitudinal movement (e.g., along the y-axis) relative to the scorer and cutting assembly 170 and, by extension, relative to the cutting wheel 185. A threaded adjustor knob 182 is coupled to the scorer and cutting assembly 170 and is rotatable to adjust, in the longitudinal direction, the position of the scorer carriage 181. A lock nut 183 is provided to prevent substantial movement of the adjustor knob 182 when the scorer carriage 181 has been adjusted to the desired position. When the scorer and cutting assembly 170 is in the engaged position, the scorer 180 is configured to score a scoring path 192 (FIG. 15B) into the printer cartridge 130 as the printer cartridge 130, contained within the cartridge holder 115, moves along the conveyor 110. The scorer 180 includes at least one scoring blade 195*a* for scoring the scoring path 192. By mounting the scorer 180 in the moveable scorer carriage 181 the depth of the scoring path 192 may be adjusted independently of the cutting wheel 185.

The cutting wheel 185 is rotatably coupled to the scorer and cutting assembly 170 in an idle manner (e.g., the cutting wheel 185 freely spins). When the scorer and cutting assembly 170 is in the engaged position, the cutting wheel 185 is configured to cut, or split, the printer cartridge 130 along the scoring path 192 (FIG. 15B) created by the scorer 180 as the printer cartridge 130, contained within the cartridge holder 115, moves along the conveyor 110. The scoring path 192 functions to guide cutting wheel 185 during the final cut through the upper surface of the cartridge 130 and in some embodiments may reduce wandering of the cutting wheel 185 during the cutting operation to provide a cleaner, straighter cut.

The stabilizer 190, along with the stabilizer receiver 175, are configured to stabilize the scorer and cutting assembly 170 when in the engaged position. Stabilizing the scorer and cutting assembly 170 promotes a substantially straight split, or cut, in the printer cartridge 130. When the scorer and cutting assembly 170 is in the engaged position, the stabilizer receiver 175 receives the stabilizer 190. When received by the stabilizer receiver 175, the stabilizer 190 comes into contact with a cutting-depth adjuster 200. The cutting-depth adjuster 200 is configured to adjust a cutting depth of the cutting wheel 185 by limiting the downward movement of the scorer and cutting assembly 170 when the scorer and cutting assembly 170 is moved to the engaged position. In some embodiments, the cutting-depth adjuster 200 includes a nut and a bolt that may be manually adjusted by an operator to adjust the cutting depth. Once the cutting depth of the cutting wheel 185 is adjusted using the cutting-depth adjuster 200, the depth of the scoring path 192 created by the scorer 180 may be independently adjusted by releasing the lock nut 183 and adjusting the adjustor knob 182.

In some embodiments, the scorer and cutting assembly 170 further includes a cutting wheel lock 205. The cutting wheel lock 205 is configured to lock or prevent the cutting wheel 185 from freely rotating. Once locked, the cutting wheel 185 may be removed or replaced after removing a cutting wheel cover 210.

Figure 10:
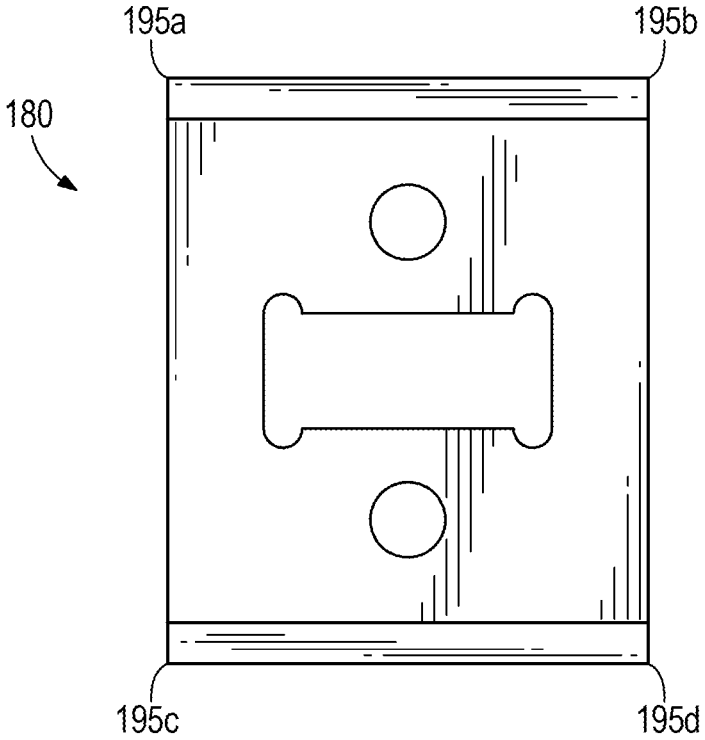
FIG. 10 is a front view of a scorer of the cutting head of FIG. 8.

FIG. 10 illustrates the scorer 180 according to some embodiments of the invention. In such an embodiment, the scorer 180 includes a plurality of scoring blades 195*a*-195*d*. By removing a scorer cover 215 that attaches to the scorer carriage 181 (FIG. 8), the scorer 180 may be rotated to place at least one of the scoring blades 195*a*-195*d* into the scoring position. Thus, in such an embodiment, when at least one of the scoring blades 195*a*-195*d* deteriorates, the scorer 180 can be rotated such that a non-deteriorated scoring blade is placed into the scoring position.

Figure 11:
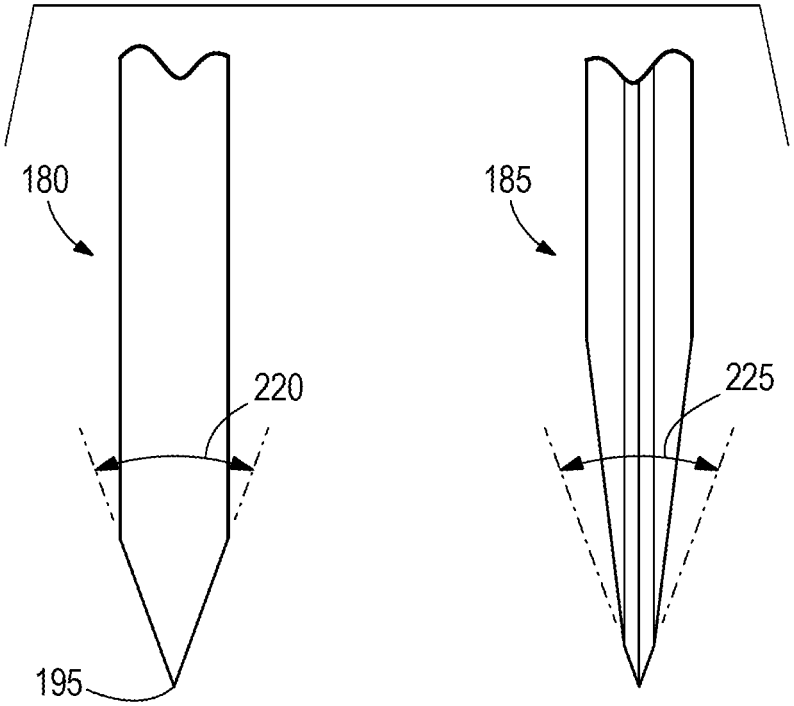
FIG. 11 is a front view illustrating a scoring blade angle of the scorer of FIG. 10 and a cutting blade angle of a cutting wheel of the cutting head of FIG. 8.

FIG. 11 illustrates the scoring blade 195 of the scorer 180 and the cutting wheel 185, according to one embodiment of the invention. In such an embodiment, the scoring blade 195 has a scoring blade angle 220 and the cutting wheel 185 has a cutting blade angle 225. In such an embodiment, the scoring blade angle 220 and the cutting blade angle 225 are substantially similar. However, in other embodiments, the scoring blade angle 220 and the cutting blade angle 225 may be different.

Figure 12:
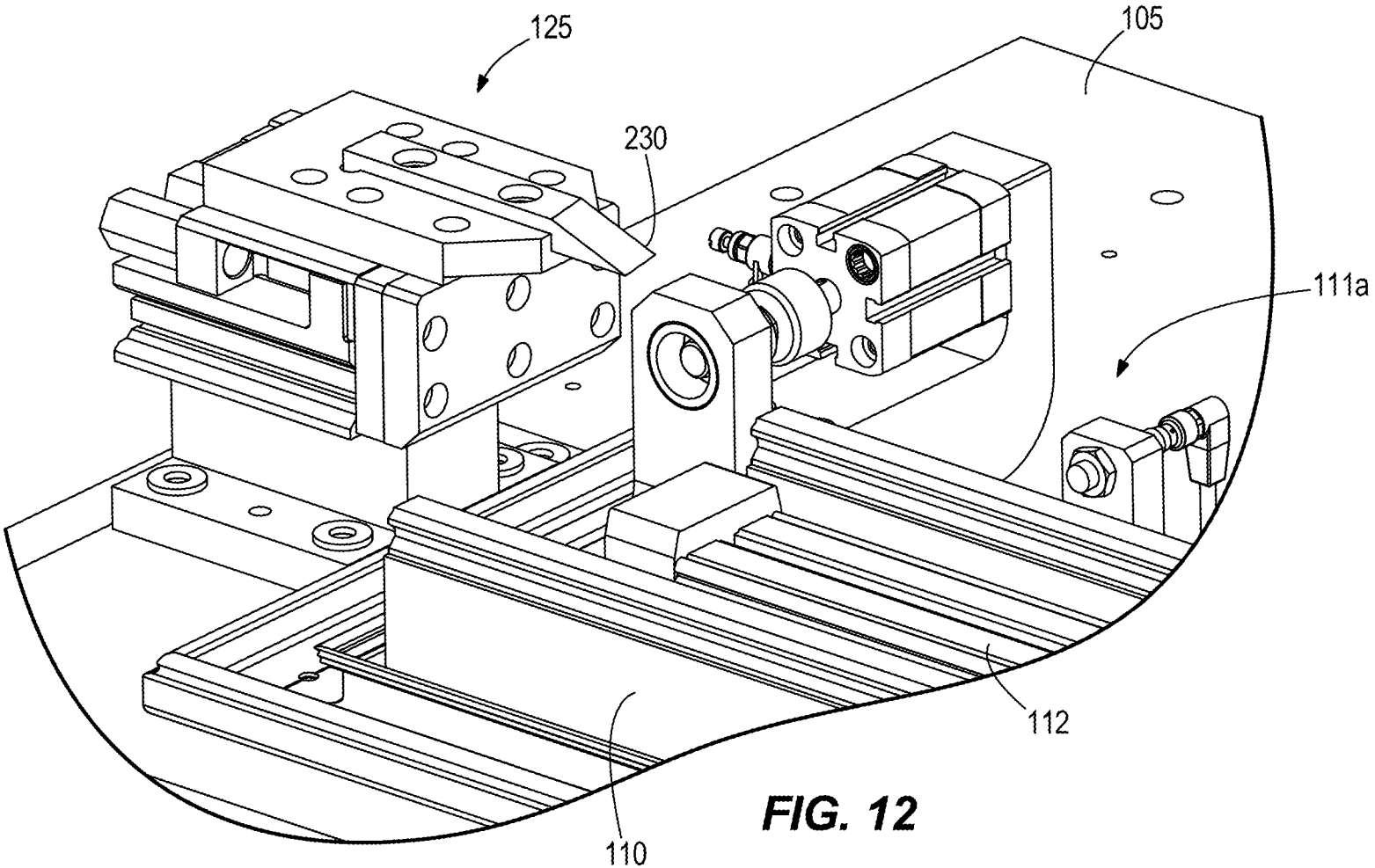
FIG. 12 is a perspective view of a cartridge splitter of the system of FIG. 1.

FIG. 12 illustrates a perspective view of the cartridge splitter 125. The cartridge splitter 125 is movably coupled (e.g., configured to move in a latitudinal direction) to the base 105 and includes a splitter edge 230. The splitter edge 230 is configured to split the printer cartridge 130 at an angle perpendicular to the scoring path 192. In operation, after the printer cartridge 130 is cut by the cutting wheel 185, the printer cartridge 130 is locked into position at the first end 111*a* of the conveyor 110, near the cartridge splitter 125. The splitter edge 230 is then inserted into the printer cartridge 130 to affect splitting of the printer cartridge at an angle perpendicular to the scoring path 192.

Figure 13:
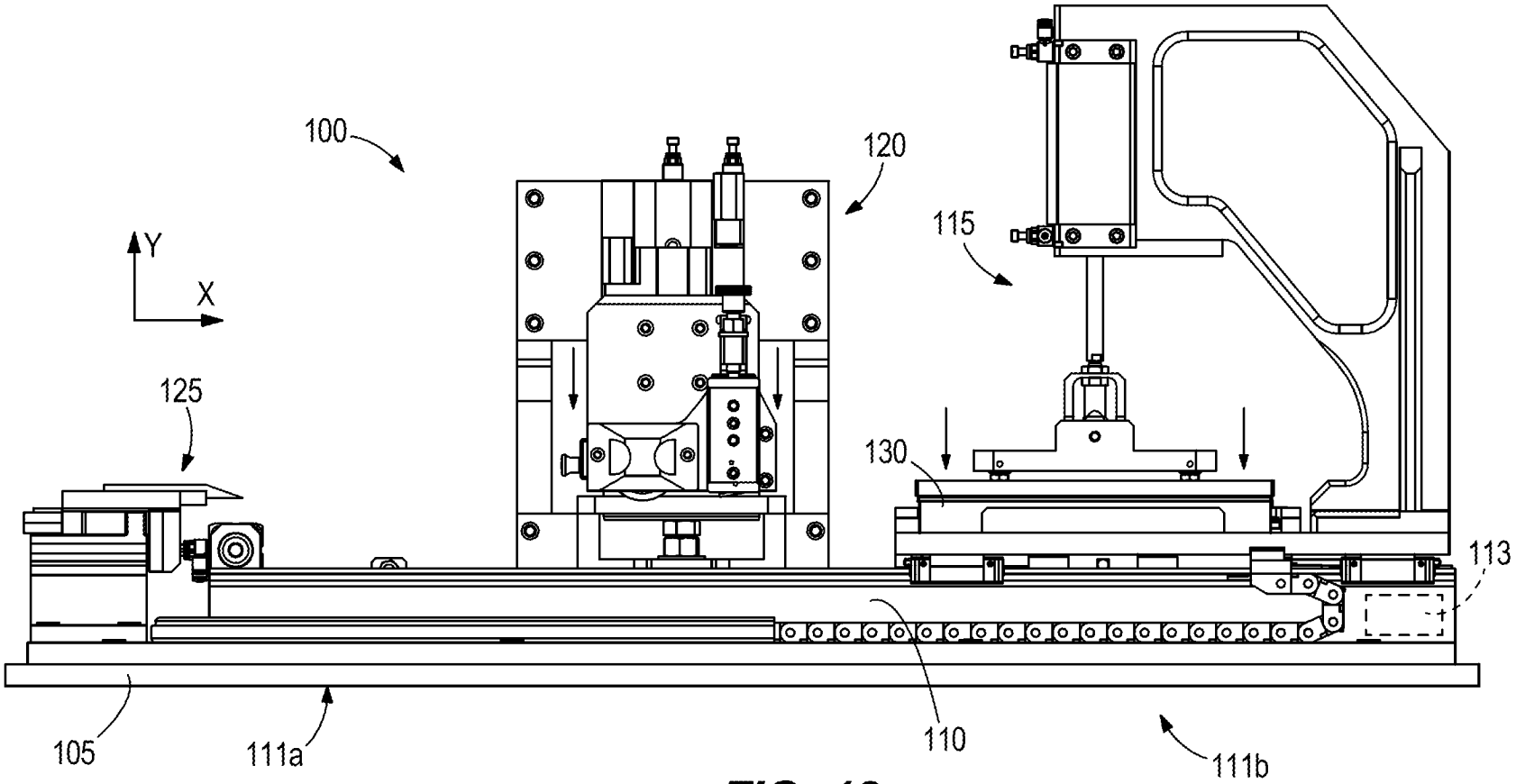
FIG. 13 is a front view of the system of FIG. 1 with the cartridge holder in a clamped position and the cutting head in an engaged position.
Figure 14A:
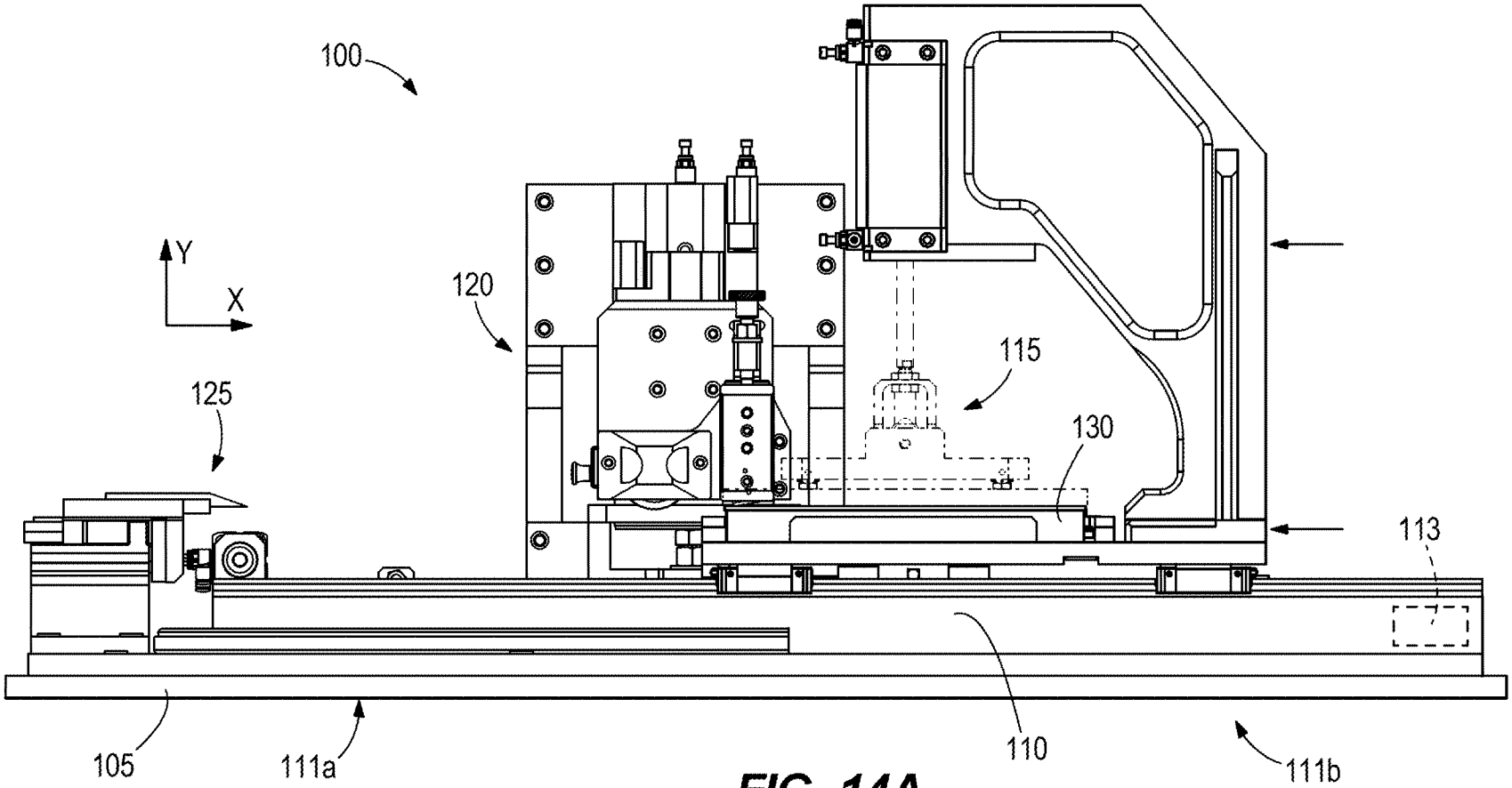
FIG. 14A is a front view of the system of FIG. 1 with the clamp of the cartridge holder removed for illustrative purposes and the printer cartridge in a scoring position.
Figure 14B:
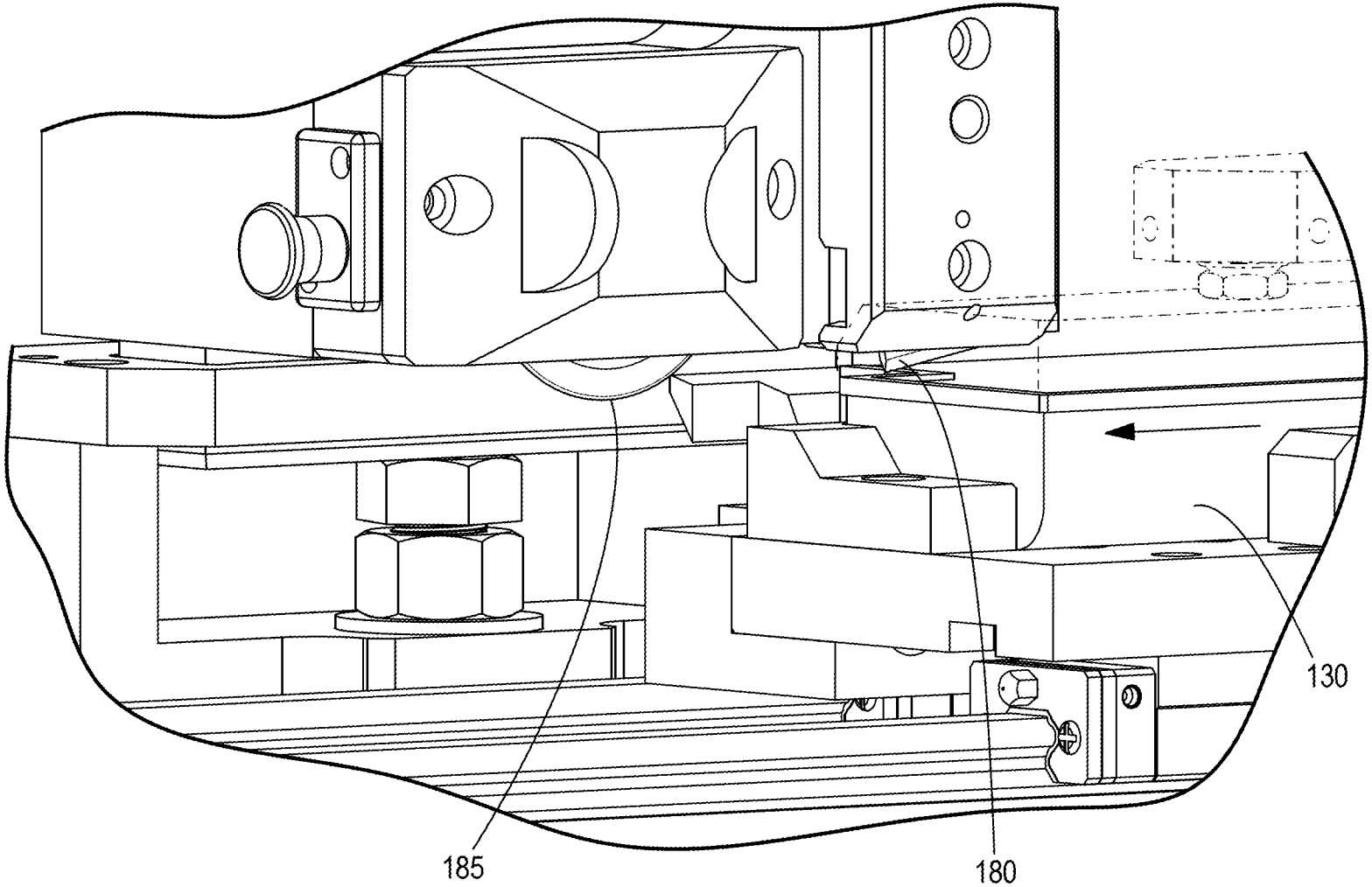
FIG. 14B is a perspective view of the printer cartridge in the scoring position.

FIGS. 13-17 illustrate an exemplary operation of the system 100. As illustrated in FIG. 13, after the printer cartridge 130 is secured within the cartridge holder 115, the cartridge holder 115 moves along the conveyor 110 toward the cutting head 120. As the printer cartridge 130 moves toward the cutting head 120, the printer cartridge 130 first comes into contact with the scoring blade 195 of the scorer 180. As the printer cartridge 130 continues to move along the conveyor 110, via the cartridge holder 115, the scoring path 192 is scored into the printer cartridge 130. The printer cartridge 130 next comes into contact with the cutting wheel 185. As the printer cartridge 130 continues to move along the conveyor 110, via the cartridge holder 115, the cutting wheel 185 splits, or cuts, the printer cartridge 130 along the scoring path 192. Because the cutting wheel 185 is mounted in an idle manner, movement of the printer cartridge 130 beneath the cutting wheel 185 causes the cutting wheel to rotate. In this way, the rotational speed of the cutting wheel 185 during a cutting operation is determined by the linear speed of the cartridge holder 115 along the conveyor 110. As discussed above, the printer cartridge 130 is then locked into position at the first end 111*a* of the conveyor 110 and the splitter edge 230 is inserted into the printer cartridge 130 to affect splitting of the printer cartridge at an angle perpendicular to the scoring path 192.

Figure 18:
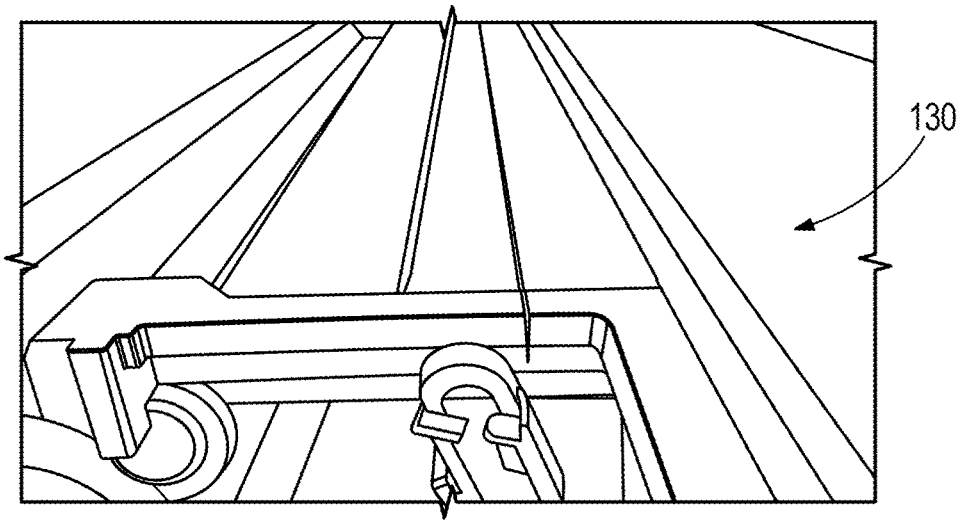
FIG. 18 is a side view of the printer cartridge after being cut by the cutting head of FIG. 8.
Figure 19:
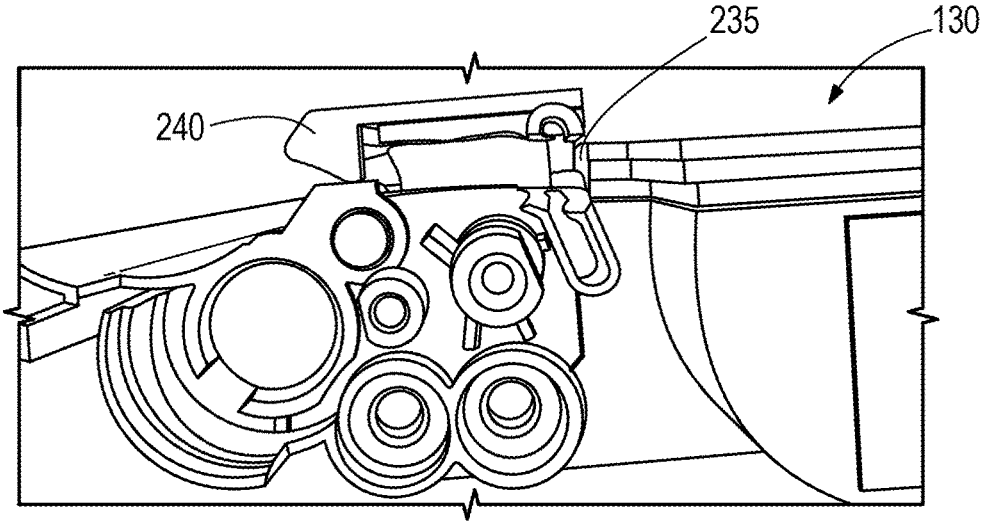
FIG. 19 is a side view of the printer cartridge after being split by the cartridge splitter of FIG. 12.
Figure 20:
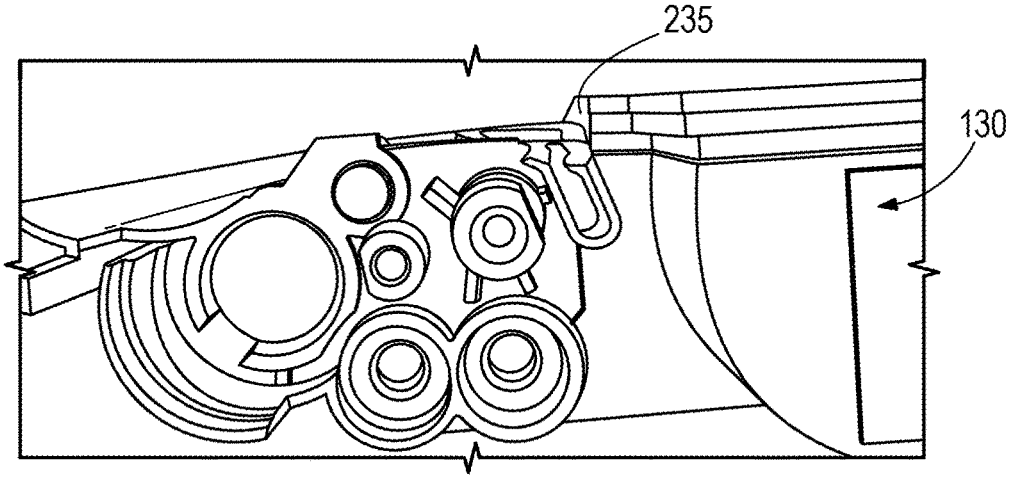
FIG. 20 is a side view of the printer cartridge having a portion removed to provide access to the inside of the printer cartridge.

FIGS. 18-20 illustrate a side view of the printer cartridge 130 in various stages of being split open. FIG. 18 illustrates the printer cartridge 130 after being split, or cut, by the cutting wheel 185. FIG. 19 illustrates the printer cartridge 130 after being split by the splitter edge 230 in a direction perpendicular the scoring path 192. As illustrated, the scoring path 192 is substantially adjacent to an internal support wall 235 of the printer cartridge 130. More specifically, when setting up the system 100, the system is arranged such that the scoring path 192 in the illustrated embodiment is located substantially adjacent to a substantially vertical internal wall of the printer cartridge 130. Those skilled in the art will recognize that different printer cartridges 130 may have different internal structures and may therefore have internal support walls in different locations. By positioning the scoring path along or adjacent to the internal support structure of a given cartridge deflection of the surface being cut may be reduced. Thus, in the illustrated embodiment, the printer cartridge 130 is split adjacent to the internal support wall 235. FIG. 20 illustrates the printer cartridge 130 having a portion 240 removed to provide access to the inside of the printer cartridge 130 for cleaning and part replacement purposes.

In another embodiment, the cutting head 120 is movably coupled to the conveyor 110, while the cartridge holder 115 is stationary. In such an embodiments, the cutting head 120 moves toward the cartridge holder 115 to affect splitting, or cutting, of the printer cartridge 130.

Thus, the invention provides, among other things, a system and method for splitting a printer cartridge. Various features and advantages of the invention are set forth in the following claims.

What is claimed is:

1. A system for splitting a printer cartridge, the system comprising:
- a cartridge holder including
  - a receiver for receiving the printer cartridge, and
  - a clamp for securing the printer cartridge in the receiver;
- a scorer configured to score a scoring path into the printer cartridge;
- a cutting head including an idling cutting wheel configured to split the printer cartridge; and
- a conveyor providing relative movement between the secured printer cartridge and the cutting head to affect splitting of the printer cartridge.

2. The system of claim 1, wherein the cartridge holder is configured to move along the conveyor toward the cutting head.

3. The system of claim 2, wherein the cutting head is moveable in a direction perpendicular to the conveyor and is configured to be in an engaged position and an unengaged position.

4. The system of claim 1, wherein the cutting head further includes the scorer.

5. The system of claim 1, wherein a scoring depth of the scorer is adjustable relative to the cutting wheel.

6. The system of claim 1, wherein the scoring path is scored into the printer cartridge prior to the printer cartridge being split by the cutting wheel.

7. The system of claim 1, wherein the scorer includes a scoring blade having a scoring blade angle substantially similar to a cutting blade angle of the cutting wheel.

8. The system of claim 1, wherein the scorer includes a plurality of scoring blades, each scoring blade being substantially similar, the scorer adjustable in the cutting head to position one of the scoring blades in a scoring position.

9. The system of claim 1, further comprising a stabilizer and a stabilizer receiver, wherein the stabilizer is received by the stabilizer receiver when the cutting head is in an engaged position.

10. The system of claim 9, wherein a cutting depth of the cutting head is adjustable via the stabilizer receiver.

11. The system of claim 1, wherein the cutting head further includes a cutting wheel lock configured to prevent the cutting wheel from idling.

12. The system of claim 1, wherein the clamp includes a pivotable clamp member configured to accommodate irregularities in the printer cartridge and to secure the printer cartridge in the receiver.

13. A method of splitting a printer cartridge, the method comprising:
- receiving the printer cartridge into a receiver of a cartridge holder;
- securing the printer cartridge into the receiver via a clamp of the cartridge holder;
- scoring the printer cartridge via a scorer;

splitting the printer cartridge via an idling cutting wheel of a cutting head; and providing relative movement between the secured printer cartridge and the idling cutting wheel to affect splitting of the printer cartridge.

14. The method of claim 13, wherein the step of providing relative movement between the secured printer cartridge and the idling cutting wheel includes moving the cartridge holder along a conveyor toward the cutting head.

15. The method of claim 13, further comprising moving the cutting head from an unengaged position to an engaged position.

16. The method of claim 13, wherein the step of scoring the printer cartridge further includes the scorer having a scoring blade.

17. The method of claim 13, wherein scoring the printer cartridge includes scoring a scoring path in the printer cartridge and wherein splitting the printer cartridge via the idling cutting wheel includes splitting the printer cartridge along the scoring path.

18. The method of claim 13, further comprising stabilizing the cutting head via a stabilizer being received by a stabilizer receiver when the cutting head is in an engaged position.

19. The method of claim 18, further comprising adjusting the cutting depth of the cutting head via the stabilizer receiver.

20. The method of claim 13, wherein splitting the printer cartridge includes splitting the printer cartridge along a scoring path that is substantially adjacent to an internal support wall of the printer cartridge.

21. The method of claim 13, wherein the step of securing the printer cartridge includes securing the printer cartridge with a pivotable clamp member configured to accommodate irregularities in the printer cartridge.

22. A system for splitting a printer cartridge, the system comprising:

a base;

a scorer configured to score a scoring path into the printer cartridge;

a cutting head coupled to the base, the cutting head including an idling cutting wheel;

a conveyor coupled to the base; and a cartridge holder movably coupled to the conveyor, the cartridge holder configured to receive the printer cartridge and move the printer cartridge toward the idling cutting wheel to affect splitting of the printer cartridge by the idling cutting wheel.

23. The system of claim 22, wherein the cutting head is moveable in a direction perpendicular to the conveyor and is configured to be in an engaged position and an unengaged position.

24. The system of claim 22, wherein the cutting head further includes the scorer.

25. The system of claim 22, wherein a scoring depth of the scorer is adjustable relative to the cutting wheel.

26. The system of claim 22, wherein the scoring path is scored into the printer cartridge prior to the printer cartridge being split by the cutting wheel.

27. The system of claim 22, wherein the scorer includes a scoring blade having a scoring blade angle substantially similar to a cutting blade angle of the cutting wheel.

28. The system of claim 22, wherein the scorer includes a plurality of scoring blades, each scoring blade being substantially similar, the scorer adjustable in the cutting head to position one of the scoring blades in a scoring position.

29. The system of claim 22, further comprising a stabilizer and a stabilizer receiver coupled to the base, wherein the stabilizer is received by the stabilizer receiver when the cutting head is in an engaged position.

30. The system of claim 29, wherein a cutting depth of the cutting head is adjustable via the stabilizer receiver.

31. The system of claim 22, wherein the cutting head further includes a cutting wheel lock configured to prevent the cutting wheel from idling.

32. The system of claim 22, wherein the clamp includes a pivotable clamp member configured to accommodate irregularities in the printer cartridge and to secure the printer cartridge in the receiver.

* * * * *